United States Patent [19]

Hellmann et al.

[11] Patent Number: 4,942,837

[45] Date of Patent: Jul. 24, 1990

[54] ICE BREAKER

[75] Inventors: Jens-Holger Hellmann, Hamburg; Richard Hölscher, Embsen; Hermann J. Janssen; Alfred Kleemann, both of Emden; Karl-Heinz Rupp, Hamburg; Joachim Schwarz, Hansdorf; Günter Varges, Emden; Heinrich Waas, Bonn, all of Fed. Rep. of Germany

[73] Assignee: Thyssen Nordseewerke GmbH, Emden, Fed. Rep. of Germany

[21] Appl. No.: 302,006

[22] Filed: Jan. 26, 1989

[30] Foreign Application Priority Data

Feb. 18, 1988 [DE] Fed. Rep. of Germany ... 8802053[U]

[51] Int. Cl.[5] ..... B63B 35/12; B63B 35/08

[52] U.S. Cl. ..... 114/40; 114/42

[58] Field of Search ..... 114/40, 41, 42, 43, 114/56

[56] References Cited

U.S. PATENT DOCUMENTS

| | | | |
|---|---|---|---|
| 3,690,281 | 9/1972 | Gray | 114/41 |
| 3,705,564 | 12/1972 | Wilhelmsen | 114/41 |
| 3,931,780 | 1/1976 | Waas | 114/41 |
| 3,983,830 | 10/1976 | Morgan | 114/40 |
| 4,326,476 | 4/1982 | Pole | 114/40 |
| 4,369,725 | 1/1983 | Lord et al. | 114/40 |
| 4,436,046 | 3/1984 | Braley | 114/40 |
| 4,506,617 | 3/1985 | Waas et al. | 114/41 |
| 4,702,187 | 10/1987 | Heideman et al. | 114/40 |
| 4,732,101 | 3/1988 | Varges | 114/41 |

FOREIGN PATENT DOCUMENTS

| | | | |
|---|---|---|---|
| 721159 | 4/1942 | Fed. Rep. of Germany | 114/56 |
| 2823072 | 11/1979 | Fed. Rep. of Germany | 114/40 |
| 0895799 | 1/1982 | U.S.S.R. | 114/41 |
| 0903243 | 2/1982 | U.S.S.R. | 114/41 |
| 0918173 | 4/1982 | U.S.S.R. | 114/40 |
| 1070047 | 1/1984 | U.S.S.R. | 114/56 |

*Primary Examiner*—Andres Kashnikow
*Assistant Examiner*—Christopher G. Trainor

[57] ABSTRACT

An icebreaker hull having laterally projecting hull components which define inclined upwardly and rearwardly sloped faces arranged in part above and in part below the vessels normal water line, and each hull component further including a longitudinally extending face cooperating with the inclined face to define a cutting edge. At least a second pair of similar projecting hull components adjacent the first components to define a second cutting edge downstream of the first cutting edge. One or more of these hull components may be movable from and to positions where they are stowed in streamline relationship to the hull.

13 Claims, 10 Drawing Sheets

ICE BREAKER

BACKGROUND OF THE INVENTION

The present invention relates to an icebreaking ship hull with devices for improving the maneuverability of the vessel and deals more particularly with a ship's hull having laterally projecting hull components arranged on the vessels side wall. These projections are preferably arranged at the widest point of the vessel's underwater hull, and may be retracted into recesses in the hull.

Icebreaking hulls generally have been provided with ice fracturing or cutting edges such edges generally extend in a longitudinal direction relative to the vessels center line and are generally provided at the bow of the vessel. Movable hull components have been suggested as a solution to the problem of an icebreaker operating in a narrow channel environment, and also to permit operation in narrow locks or in negotiating a curved channel. If the typical icebreaker is required to break out of the main channel to provide an auxiliary channel for bringing relief to vessels in a convoy or the like such movable hull components can be quite useful.

SUMMARY OF THE INVENTION

The present invention provides an icebreaking ship hull wherein at least two cooperating hull components are adapted to project laterally from the side of the vessel, and these components preferably include an inclined face for engagement with the ice broken as the vessel travels in a generally longitudinal direction. These projecting hull components further include a longitudinally extending lateral face with portions both above and below the water line and which cooperate with the inclined face to define a cutting edge. As a result at least two cutting edges are provided on the vessel side wall to facilitate breaking up of the ice.

Certain of these hull components are movable and means is provided for moving these hull components or segments thereof between positions where the segments are provided in recesses defined by the hull.

Projecting portions of the hull components provided in the hull forebody may cooperate with one another to act on the ice sheet sequentially. These hull components may be provided one adjacent another with the downstream portions projecting further from the hull, and alternatively may be provided in longitudinally spaced relationship along the hull.

Finally, in still another version the ship hull may comprise two articulated hull portions connected by means of at least one resiliently shaped pillow member such as a fender or the like, and with clamping means plus pivot defining means so that the longitudinal axes of one hull portion can be swung about a vertical axis relative to the other hull portion.

DETAIL DESCRIPTION

Figure 1:
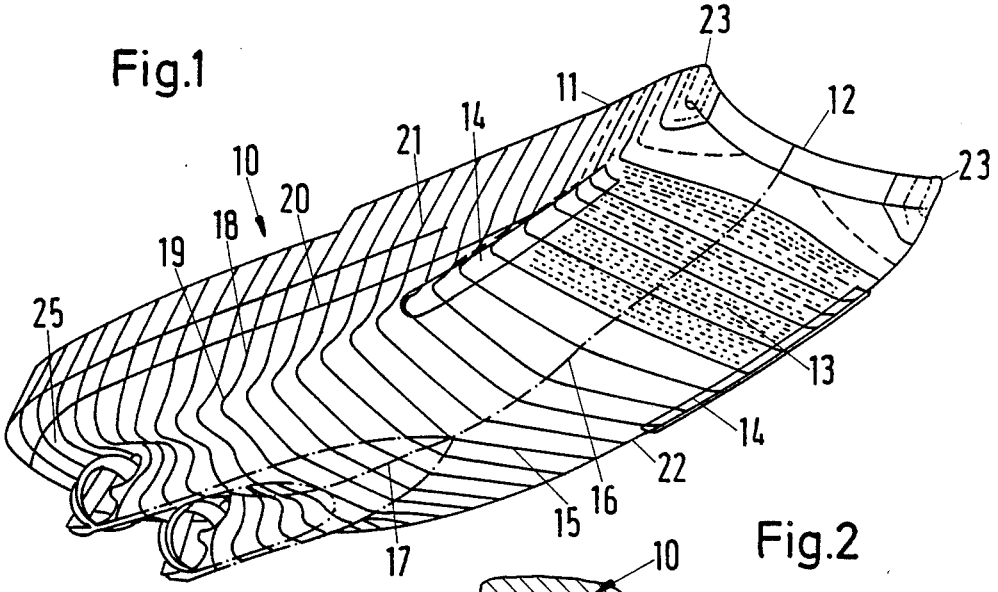
FIG. 1 is a perspective view taken from a point forward of the vessel's bow and slightly to the right and below the vessel's direction of travel.

Turning now to the drawings in greater detail, FIG. 1 illustrates an icebreaking ship hull of the type best adapted to be fitted with laterally projecting hull components according to the present invention. The hull includes a fore body indicated generally at 11 having laterally spaced bow pontoons 23 and a concave underwater surface 13 therebetween. Laterally spaced inclined edges 14, 14 originate with the bow pontoons 23, 23 and extending aft so as to form a contoured configuration as suggested generally at 19, whereby the rear of the ship's hull is protected from damage by ice in the area of the propellers.

Figure 2:
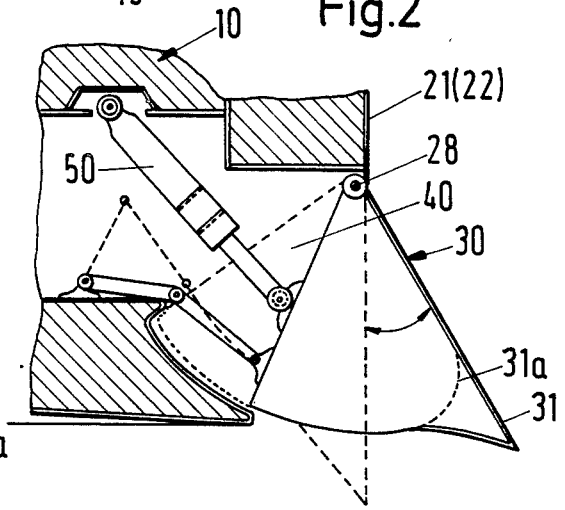
FIG. 2 is a vertical section through a portion of the hull forebody adjacent the water line illustrating a laterally projecting hull component in its extended position, and in its retracted position in broken lines.
Figure 3:
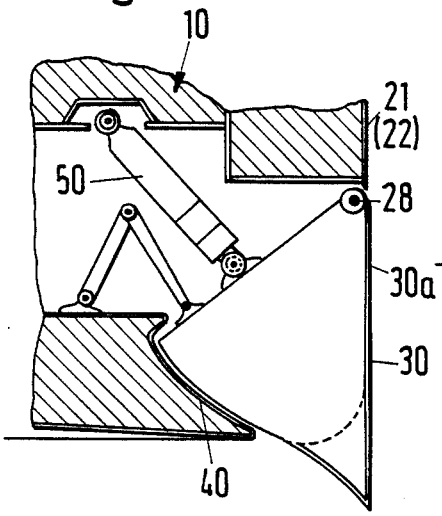
FIG. 3 shows the structure of FIG. 2 in its retracted position.
Figure 4:
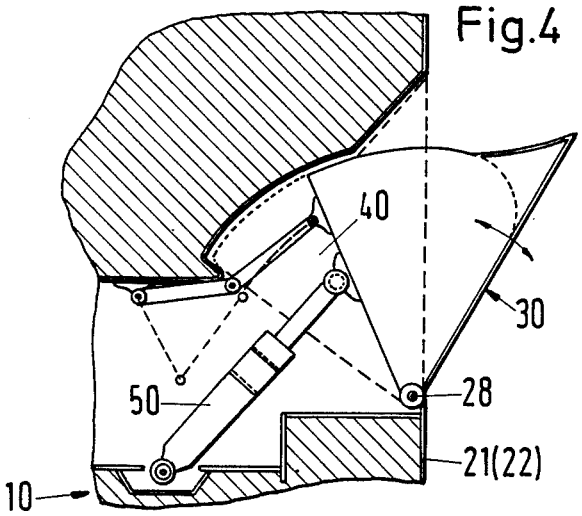
FIG. 4 shows an alternative embodiment for the movable hull component of FIGS. 2 and 3, with the pivot axis of the component being provided below the component itself, and with the component being configured relative to a recess in the hull, and the component is contoured to the hull shape when in its retracted position.

Icebreaking hull components 30, 30 best shown in FIGS. 2, 3 and 4 are provided in the area of the forebody 11 and more particularly in the area of the edges 14, 14 of the forebody. These hull components may be stationary or movable and will be described in greater detail below.

The hull water line is indicated generally at 20 in FIG. 1 and in the description that follows the ice sheet is indicated generally at 200 in the drawings.

Figures 5, 6:
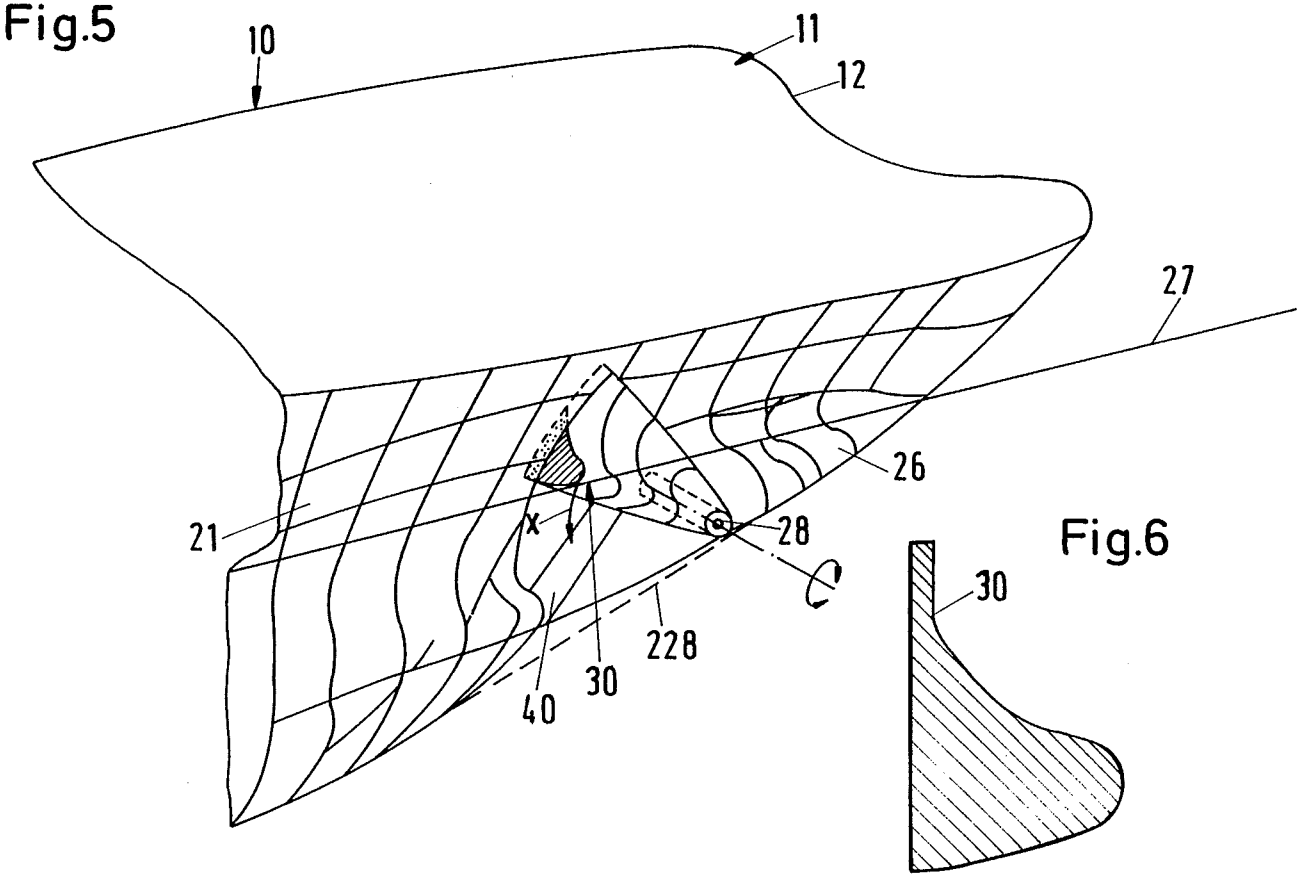
FIG. 5 shows a forebody section of the ship's hull, with a movable hull component being provided on an axis that extends perpendicularly to the longitudinal axis of the vessel rather than being provided with a longitudinal orientation as is true of the movable hull components illustrated in FIGS. 2, 3 and 4.
FIG. 6 shows in somewhat more detail the cross sectional configuration of the hull component illustrated in FIG. 5.

The hull components 30, 30 may also be provided along the hull sidewall 21, 22 and these components may be either movable as shown in FIGS. 2, 3 and 4 and in FIGS. 5 and 6, or be fixed as suggested in FIGS. 12–21.

With reference to FIGS. 2 and 3, the projecting hull component 30 can be seen to pivot on a generally horizontal axis 28 provided in generally parallel relationship to the center line of the vessel's hull so as to be movable from a retracted to a deployed position as shown in solid lines in FIG. 2 wherein the hull component projects larterally beyond the hull sidewall 21 (22). An actuator 50 moves the hull component to and from the retracted position shown in broken lines in FIG. 2 and in solid lines in FIG. 3 where the hull component 30 is generally faired into the hull sidewall 21 (22). The hull component may include a projecting lip portion defining a cutting edge 31 or may instead may be contoured as suggested by the broken line 31*a* in FIG. 2. The geometry of the hull component is preferably such that in its retracted position where it is located in recess 40, the surface 30*a* forms a continuation of the hull side wall 21.

As shown in FIG. 4 the projecting hull component 30 may instead of pivoting on axis 28 provided at the top of the hull component recess may instead be pivoted on an axis at the bottom of the recess 40. The hull component 30 is adapted to be retracted by the actuator 50 into its recess 40.

FIG. 5 shows a movable hull component 30 which pivots on a horizontal axis oriented perpendicular to the longitudinal ceterline 27 of the vessel.

Figure 7:
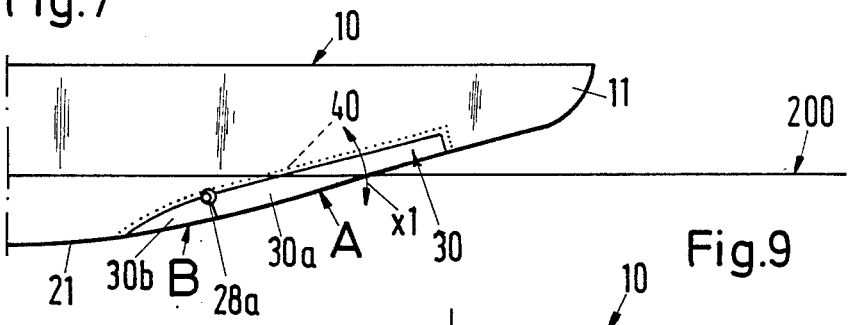
FIG. 7 shows in side elevation the forebody of a vessel provided with a movable hull component and a fixed hull component downstream of the movable component.

FIG. 7 illustrates a movable hull component 30*a* which is pivoted on an axis 28*a* and which in its retracted position as shown forms a continuation of the fixed hull forebody and aft hull component 30*b*. This pivotable hull component 30*a* has a portion above and a portion below the water line and is movable in the direction of the arrow, indicated generally at X-1. The recess 40 for the component 30*a* assures that this hull component affords a failed configuration with respect to the adjacent sidewall and forebody of the ship hull 11 when retracted.

Figure 8:
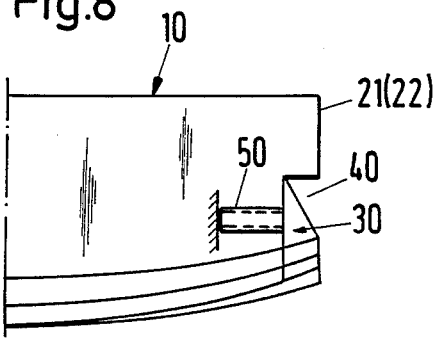
FIG. 8 is a lateral section taken through the forebody region of the hull with a hull component that is transversely displaceable.
Figure 9:
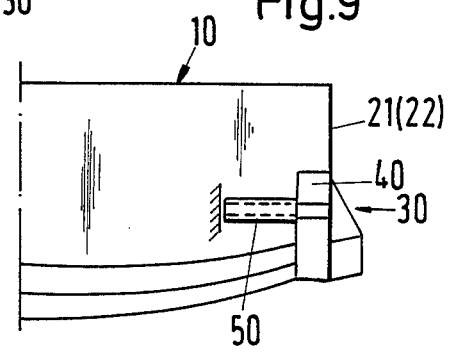
FIG. 9 shows the structure of FIG. 8 with the hull component deployed, FIG. 8 illustrating the hull component in its retracted position.

FIGS. 8 and 9 illustrate a laterally movable hull component 30 provided with an actuator 50 so as to occupy either the projecting position illustrated in FIG. 9 or the retracted position illustrated in FIG. 8.

Figure 10:
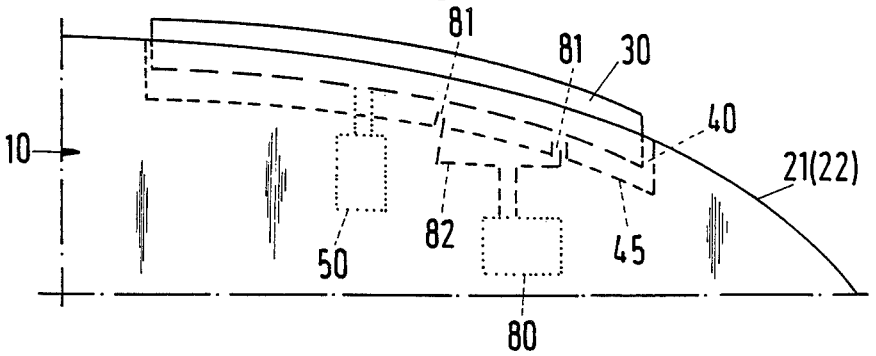
FIG. 10 shows a portion of a hull forebody with a hull component in its deployed condition and also illustrates in broken lines the recesses for receiving the hull component when in its retracted position.

In FIG. 10 the movable hull component 30 is shown deployed and it will be apparent that actuator 50 is adapted to retract this component 30 into the recess 40 defined for this purpose in the hull forebody. Movement of the component 30 is generally perpendicular in direction relative the longitudinal center line of the hull, and means 80 is provided for directing heated fluid through conduits 82 into the recess 40 so as to assure proper operation of the component 30.

Figure 11:
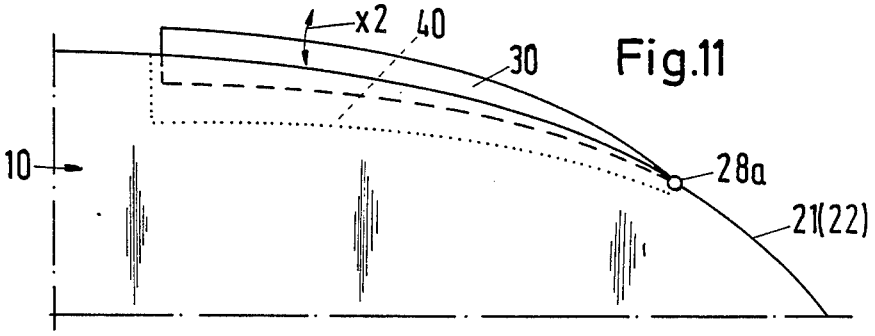
FIG. 11 shows that an alternative embodiment of the structure of FIG. 10 wherein the hull component is pivotably movable rather than translatable as illustrated in FIG. 10.
Figure 12:
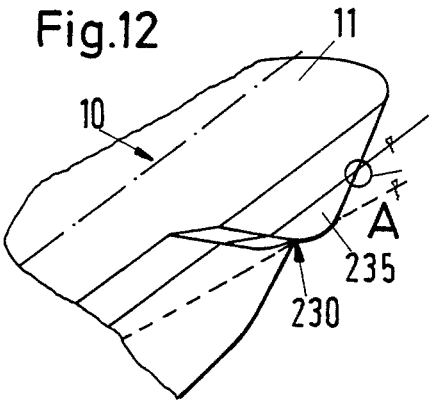
FIG. 12 is a perspective view of a hull forebody with a stationary laterally projecting hull component.

FIG. 11 shows a variation of the movable hull component of FIG. 10 where the component 30 is movable in the direction of the arrow X-2 from a retracted position (not shown) to a deployed position relative to the recess 40.

It should be noted that the recesses shown in the above described drawings for accommondating the retracted positions of the variously shaped hull components can each be fitted with suitable heating devices or flushing systems whereby pressurized water is sprayer into the cavities or recesses through orifices or nozzles provided in the recess defining walls. Such a system is diagrammatically indicated in FIG. 10 but can be adapted to the various recesses described with reference to the other embodiments as well. So too, the components themselves may be suitably constructed so as to be heatable. This direct heating of the hull components is particularly appropriate where these components are stationary rather than movable.

Figure 13:
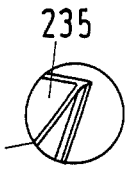
FIG. 13 is an enlarged view of the portion of the hull component as illustrated at A in FIG. 12.

FIGS. 12–21 shown laterally projecting stationary hull components 230 or 235 constructed as part of the hull sidewalls 21 or 22. The hull components are preferably provided with portions above and below the vessel's water line, and each such component includes an inclined face for engagement with the ice to be broken. Such face is inclined upwardly in the forward direction and includes a portion above and a portion below the water line. A longitudinally extending lateral face also has portions above and below the water line and these faces (namely the longitudinally extending lateral face and the upwardly inclined face) cooperate to define a cutting edge as best shown in FIG. 13 that serves to break up the ice as the vessel moves in the longitudinal direction. A rearwardly inclined face of the hull component illustrated in FIG. 12 serves to break up the ice when the vessel is moving in a sternwise direction.

Figure 19:
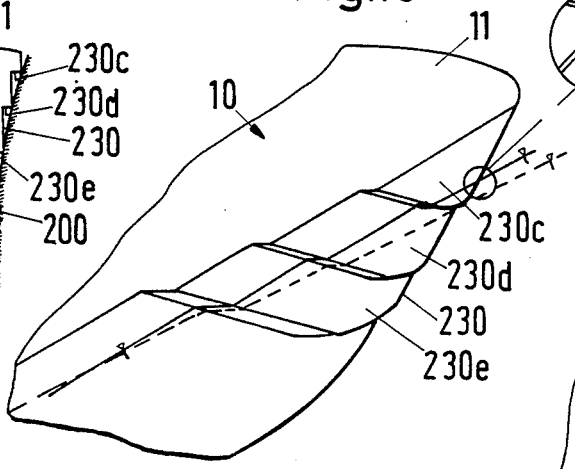
FIG. 19 shows still another embodiment of the invention where three hull components are provided in a stepped configuration arranged longitudinally of the hull.
Figure 19A:
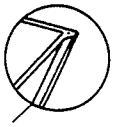
FIG. 19A is a detailed view of the hull component cutting edge at the circle in FIG. 19.
Figure 21:
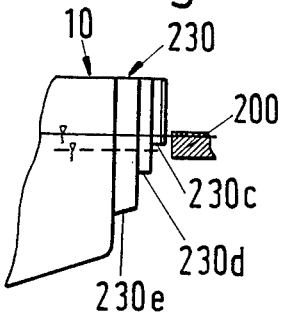
FIG. 21 is a vertical lateral section through the vessels hull and illustrates the three hull projections of FIG. 19.
Figure 24:
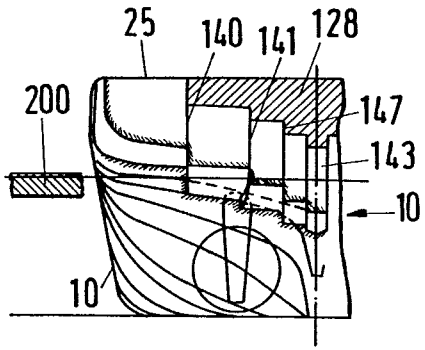
FIG. 24 is a horizontal lateral section taken through the vessel's stern area of FIGS. 22 and 23.
Figure 22:
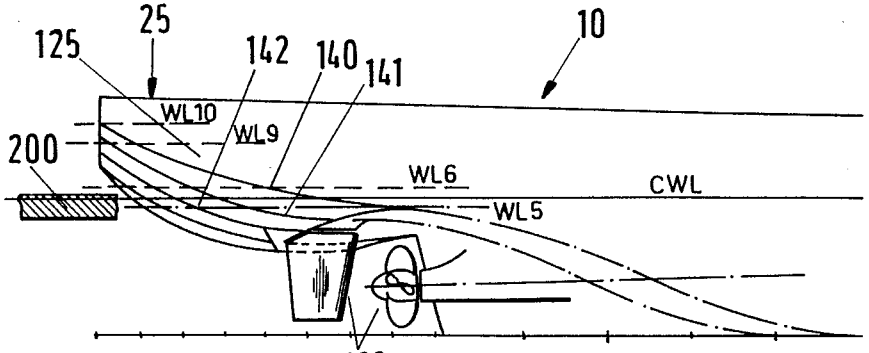
FIG. 22 is a side elevational view of the stern portion of the vessels's hull.
Figure 23:
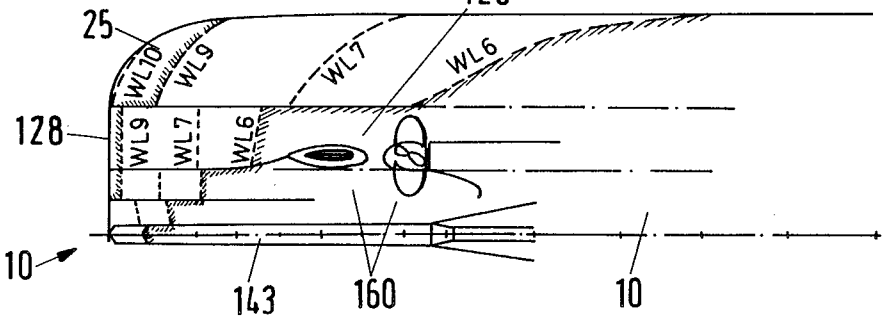
FIG. 23 is a bottom view of FIG. 2.
Figure 24A:
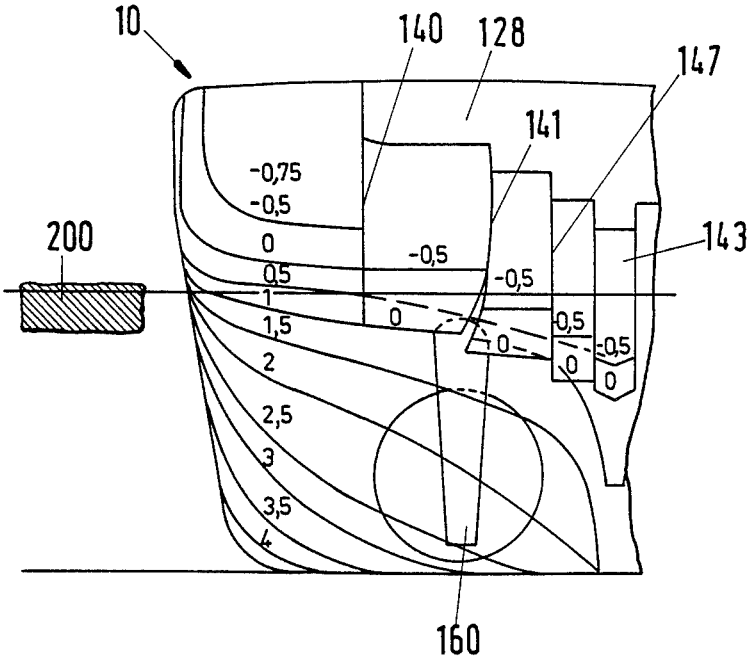
FIG. 24A is similar to FIG. 24 but drawn to a somewhat larger scale.

These projecting hull components are preferably arranged in pairs, and as shown in FIG. 19 may be arranged in stepped fashion with more than two components provided as indicated generally at 230*c*, 230*d* and 230*e*.

Figure 16:
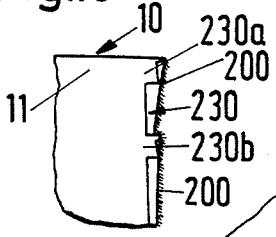
FIG. 16 is top view that illustrates the effect on an ice sheet of the two longitudinally spaced hull projections illustrated in FIG. 15.
Figure 15:
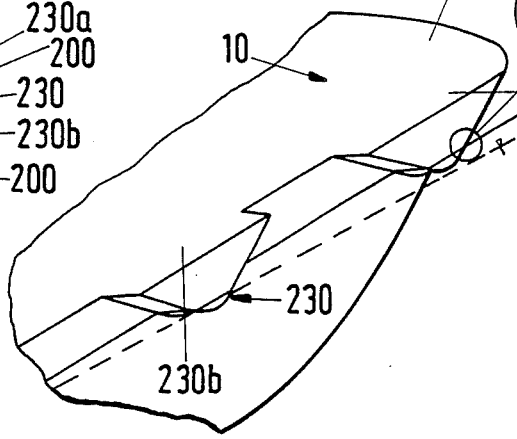
FIG. 15 is a view similar to FIG. 12 but illustrating two projecting hull components longitudinally spaced relative to one another in the hull forebody.

With reference to FIG. 15 a first and a second projecting hull component are provided each with inclined faces defining cutting edges, and as suggested in FIG. 16 these hull components cooperate to assure that the width of the channel is maximized as the vessel proceeds in an icebreaking manner relative to the ice sheet 200.

Figure 14:
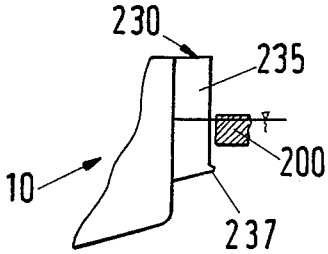
FIG. 14 is a vertical cross section through the projecting hull component of FIGS. 12 and 13, and also shows the relationship between the hull and the water line and the ice sheet at the water line.
Figure 17:
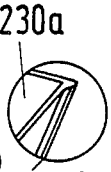
FIG. 17 is an enlarged detailed view of the portion of the hull component illustrated by the circle in FIG. 15.
Figure 18:
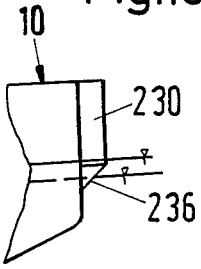
FIG. 18 is a vertical lateral section through the hull showing the hull components illustrated in FIG. 15.

As best shown in FIGS. 13 and 17 the cutting edge of each hull component may define a lip 237 which lip serves to lift the ice slightly as the vessel proceeds in its icebreaking mode. FIG. 14 illustrates the lip 237 relative to the ice sheet 200.

Figure 20:
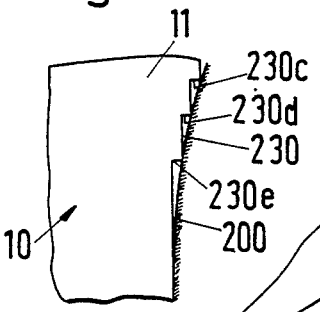
FIG. 20 is a top view of that illustrates the effect on an the ice sheet of the stepped hull components of FIG. 19.

As mentioned previously, and as shown in FIG. 19 a third hull component can be provided so that it cooperates with the first and second hull components to facilitate icebreaking action during a vessel path which is curved as suggested in FIG. 20. Here again, each hull component includes an inclined face that cooperates with a longitudinally extending lateral face to define a cutting edge, and the cutting edge may itself include a lip as suggested in FIG. 14 at 237. In the FIG. 19 version each of these projecting hull components extends further below the water line than the adjacent upstream projecting hull component so as to provide a stepped forebody configuration that is especially useful when breaking ice during the time when a vessel is following a curved path through the ice sheet.

With reference to FIGS. 22–30 various hull afterbody configurations are shown that will serve to break ice during sternwise travel of the vessel particularly in a manner such as not to interfere with the screws and rudders for driving and controlling the vessel.

Figure 27:
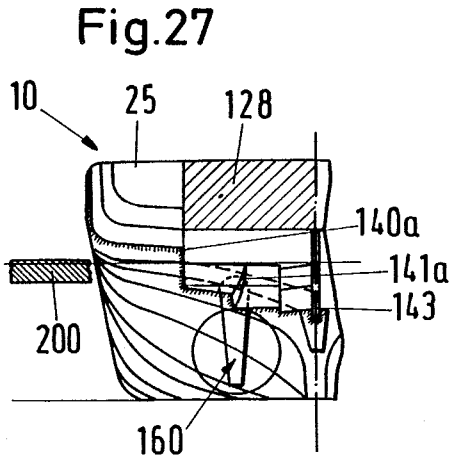
FIG. 27 is a horizontal lateral section through the vessel's stern as illustrated in FIGS. 25 and 26.
Figure 25:
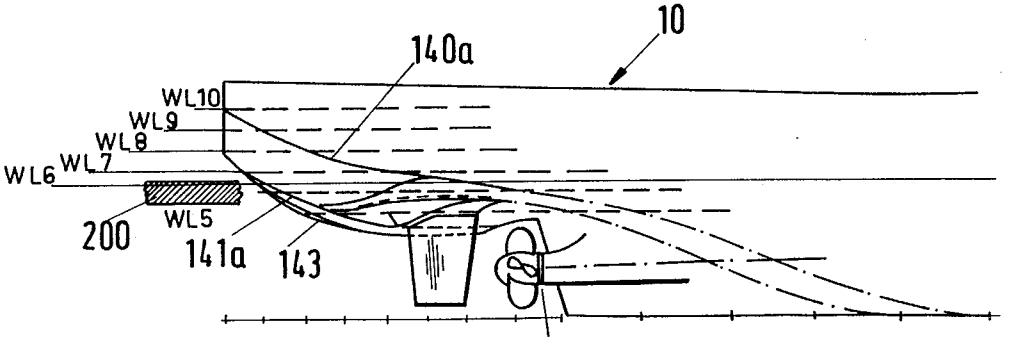
FIG. 25 is a side elevation of a vessel hull stern area.
Figure 26:
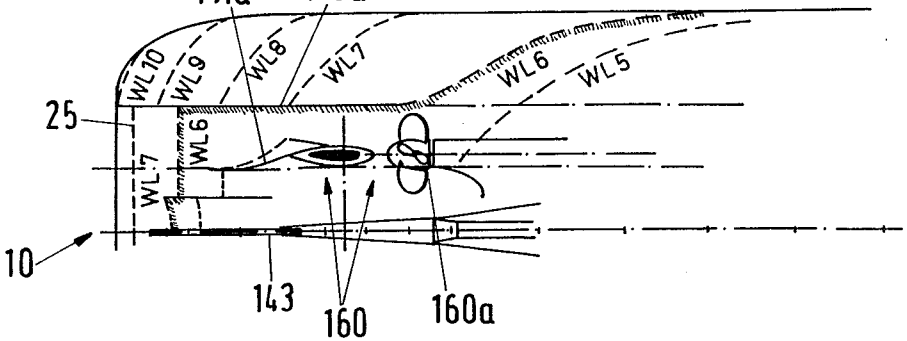
FIG. 26 is a bottom plan view of the vessel's stern illustrated in FIG. 25.
Figure 27A:
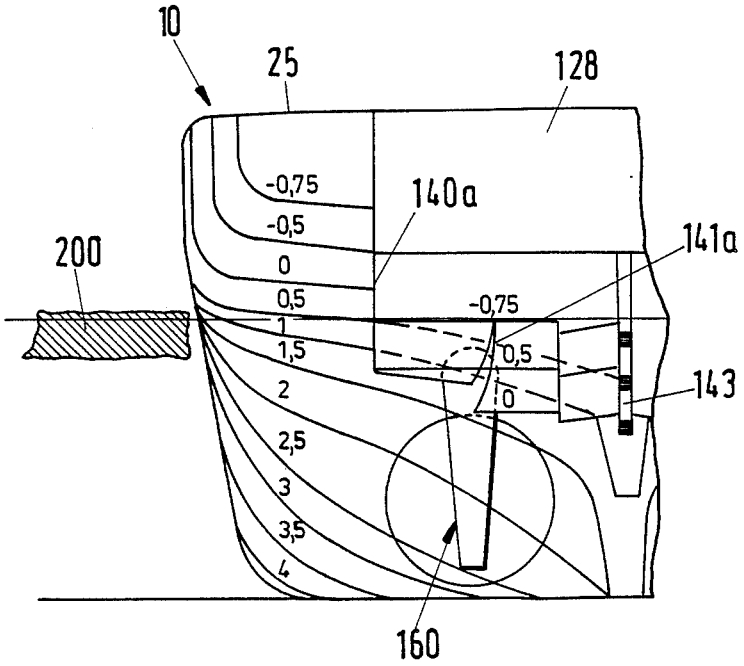
FIG. 27A is an enlarged version of the vertical section illustrated in FIG. 27.
Figure 30:
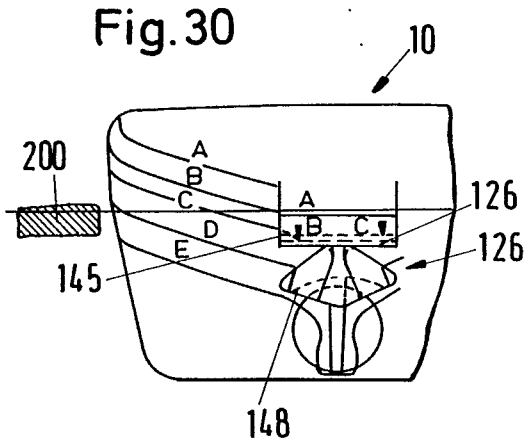
FIG. 30 is a lateral horizontal section taken generally through the stern area of the vessel hull illustrated in FIGS. 28 and 29.
Figure 28:
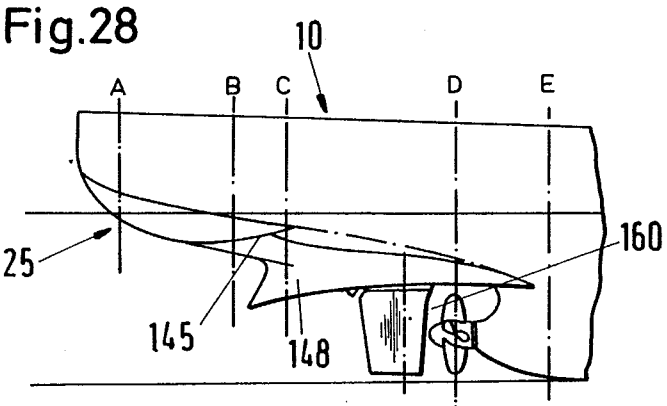
FIG. 28 is a side elevation of a vessel stern area according to still another version of the present invention.
Figure 29:
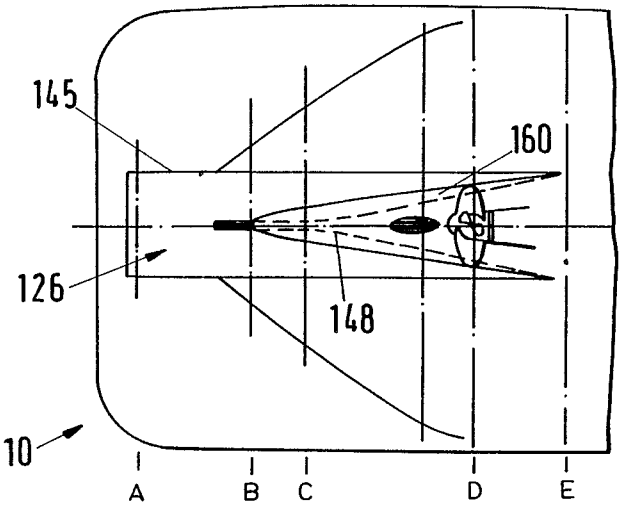
FIG. 29 is a bottom plan view of the stern portion of the vessel of FIG. 28.

In FIGS. 22–27*a* at least three different icebreaking zones are provided at the stern of the vessel the outermost zones having a symmetrical icebreaking pattern which somewhat resembles known forebody vessel shapes. The central area of the stern shape is especially useful when breaking, and in FIG. 23 a skid 143 is provided for this purpose. FIGS. 25, 26 and 27 show a somewhat different geometry for the skid 143. FIGS. 28, 29 and 30 show a stern fin 148 that is designed to clear away broken up ice from the area of propulsion and control member 160.

Figure 33:
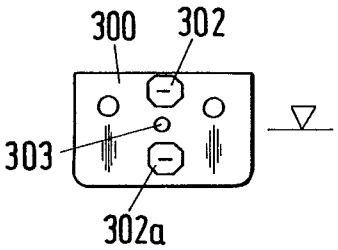
FIG. 33 is a lateral horizontal section taken on the line 33—33 of FIG. 31.
Figure 31:
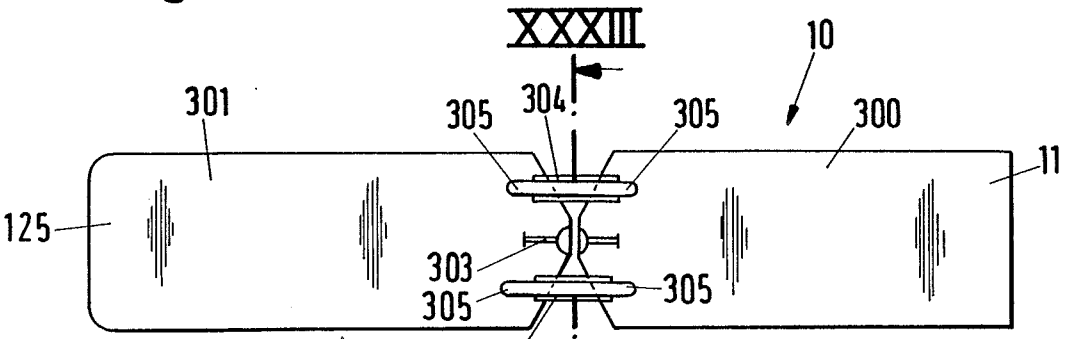
FIG. 31 is a top plan view of an icebreaking ship hull consisting of two articulated interconnected hull portions.
Figure 32:
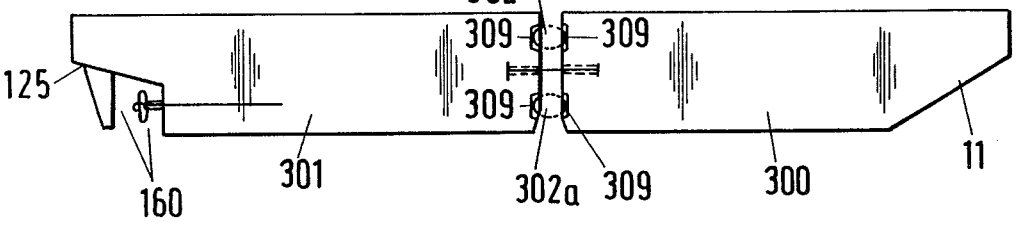
FIG. 32 is a side elevational view of the vessel illustrated in FIG. 31.

FIGS. 31, 32 and 33 show a hull configuration that comprises at least two articulated hull portions 300 and 301. These hull portions are coupled to one another by resilient shaped pillow members 302 and 302*a* vertically spaced relative to one another and located one above and one below a clamping device 303 that serves to maintain a predetermined longitudinal spacing between the hull components 300 and 301. This clamping means may comprise a hawser stretched between the two hull portions 300 and 301. In addition, these two hull portions are coupled by hydraulic pistons 304 and 304*a* which are arranged in laterally spaced relationship to the vertical pivot axis defined by the resilient pillow shaped members 302 and 302*a*. These hydraulic pistons can be operated either one at a time or in reverse directions relative to one another so as to hinge one hull portion 300 relative to the other 301. One hull portion 301 may be constructed as a pusher tug. The hydraulic pistons 304 and 304*a* can be used to pivot these hull portions relative to one another as required to negotiate a curved channel for example. It will be apparent that these hull portions 300 and 301 may be provided with stationary or movable laterally projecting hull components as described previously with reference to FIGS. 1–21 inclusively, so too, the afterbody configuration of the tug hull portion 301 can be fitted out as described previously with reference to FIGS. 22–30 inclusively.

We claim:

1. In an icebreaker having a hull with a forebody and a horizontally extending water line defining hull portions above and below said water line, the improvement to such hull forebody comprising first and second laterally projecting hull components, said first component having an inclined face for engagement with the ice to be broken, said face being inclined upwardly in the forward direction, and said face including a portion above and a portion below the water line, said first projecting hull component further including a longitudinally extending lateral face with portions both above and below the said water line and cooperating with said inclined face to define a first cutting edge, and said second laterally spaced projecting hull component being located adjacent said first projecting component, said second component also including a said longitudinally extending lateral face and a said upwardly inclined face so as to define a second cutting edge downstream of said first cutting edge.

2. The combination of claim 1 further characterized by a laterally outwardly projecting lip (237) along at least a portion of said cutting edge.

3. The combination according to claim 1 further characterized by at least one additional projecting hull component, said additional hull component including a longitudinally extending lateral face and an upwardly inclined face that cooperate to define an additional cutting edge downstream of said first and second cutting edges.

4. The combination according to claim 3 further characterized by each of said projecting components so arranged along said hull forebody that each of said projecting components extends further below the water line than the adjacent upstream projecting component so as to provide a stepped forebody configuration that is especially useful in breaking ice.

5. The combination of claim 1 wherein said hull components further include a face inclined upwardly in the rearward direction and cooperating with said lateral face to define an aft cutting edge that functions in sternwise travel as the said first and second cutting edges in forward travel of the icebreaker.

6. In an icebreaker having a hull with a forebody that includes a horizontally extending water line defining a hull forebody with portions above and below the water line, the improvement comprising laterally projecting components (230) arranged in longitudinally spaced relationship along the forebody, said projections having a progressively greater depth in the downstream direction and each projection including a generally longitudinally extending lateral face and a rearwardly facing inclined face, said inclined face sloping upwardly in a rearward direction and arranged at a substantial angle relative to the lateral face, said inclined and lateral faces having a juncture that defines a cutting edge.

7. The combination according to claim 6 wherein said laterally projecting components are arranged adjacent to one another so that the forwardmost component extends laterally beyond the next succeeding projection which in turn extends laterally beyond the next projecting component.

8. The combination according to claim 7 wherein said laterally projecting components are spaced longitudinally from one another along the hull forebody to provide a gap therebetween.

9. The combination according to claim 6 wherein at least some of said hull projecting components comprise a movable segment, and means for moving said segment between positions wherein said segments are provided in recesses defined by the hull and projecting positions wherein said components project laterally from the hull forebody.

10. The combination according to claim 9 wherein each said movable hull segment is movable on a horizontally extending hinge axis generally parallel to said water line.

11. The combination according to claim 10 wherein said hinge axes for said movable segments are oriented generally parallel to the longitudinal direction of the hull.

12. The combination according to claim 11 wherein said means for moving said segments comprise actuating means provided inside the hull, and said segments when retracted defining a continuation of the adjacent hull surface.

13. The combination according to claim 12 wherein means is provided for ejecting heated fluid into said recess when said projecting component is extended.

* * * * *